United States Patent [19]

Mitani

[11] 4,355,581

[45] Oct. 26, 1982

[54] TRUCK DRIVING APPARATUS

[75] Inventor: Yoshio Mitani, Inayama, Japan

[73] Assignee: Murata Kikai Kabushiki Kaisha, Kajo, Japan

[21] Appl. No.: 115,727

[22] Filed: Jan. 28, 1980

[30] Foreign Application Priority Data

Jan. 31, 1979 [JP] Japan ..... 54-10553
Oct. 30, 1979 [JP] Japan ..... 54-140758

[51] Int. Cl.[3] ..... B61B 13/12
[52] U.S. Cl. ..... 104/166; 74/199
[58] Field of Search ..... 104/130, 165, 166; 198/803; 74/194, 199

[56] References Cited

U.S. PATENT DOCUMENTS 3,118,393 1/1964 Ohlin ..... 104/166
3,356,040 12/1967 Fonden ..... 104/130
3,364,874 1/1968 Toennesen ..... 104/166
4,109,541 8/1978 Jesse ..... 74/194

*Primary Examiner*—Randolph A. Reese
*Attorney, Agent, or Firm*—Moonray Kojima

[57] ABSTRACT

A truck driving apparatus for driving a truck on rails presses a rotating board, with a rotating shaft fitted to the truck, against a driving shaft arranged along the pathway of the truck, and transmits the rotational force of the driving shaft to the rotating shaft of the truck. The rotating board is so constructed as to have a ring like friction disc with a friction face thereon fixed to the rotating shaft, to intersect the rotation axis of the rotating shaft at right angles. The rotation axis of the rotating shaft is inclined at a certain small angle relative to the plane intersecting the axis of the drive shaft, at right angles.

5 Claims, 13 Drawing Figures

Fig. 1-A
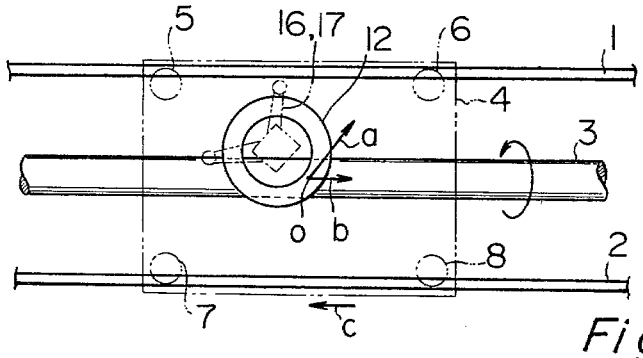
Fig. 1-B
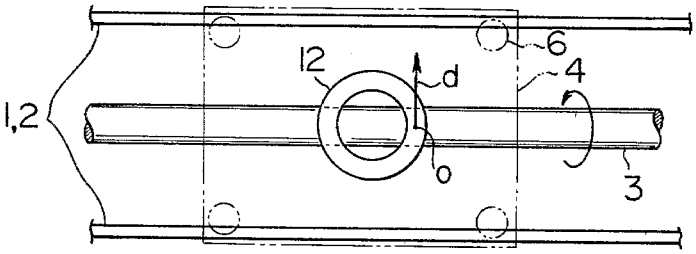
Fig. 1-C
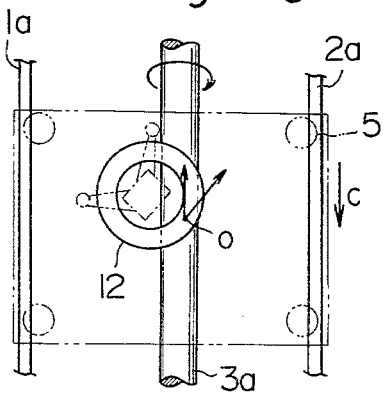
Fig. 2
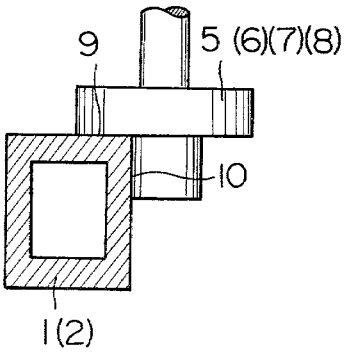

TRUCK DRIVING APPARATUS

BACKGROUND OF INVENTION

1. Field of Invention

The present invention relates to a conveyor system and more especially relates to a truck travelling on rails, on which many kinds of goods are mounted and conveyed. The trucks are used for example, for taking out or taking in goods to be stored in an automatic warehouse, for an automatic linear system in an assembly factory and for transport of people by a lift and the like.

2. Description of Prior Art

As disclosed in the specification of U.S. Pat. No. 3,118,393 or U.S. Pat. No. 3,356,040, there is known a truck driving system in which a truck is placed on two rails so that a running wheel rotatably secured to the truck is brought in contact with the rails in the lower and side portions. A friction wheel, mounted on a supporting shaft rotatably on the truck, is spring-urged and pressed to a rotating driving shaft arranged in parallel to said two rails, by a 45 degree contact between the friction wheel and driving shaft. The force acting on the friction wheel supporting shaft is divided into a component force for advancing the truck and the truck is thus driven.

This known driving system is advantageous over the conveyor system in the point that trucks can be driven at high speeds and respective trucks can be driven or stopped independently in a continuous manner or intermittently.

In the above-mentioned truck driving system, since the rotation axis of the friction wheel extends in the horizontal direction, the contact between the peripheral face of the friction wheel and the peripheral face of the driving shaft is theoretically a point-to-point contact, and therefore, the transmitted driving force is small. Accordingly, an attempt has been made to provide a face-to-face contact or line-to-line contact by increasing the diameter of the friction wheel while taking the elasticity of the peripheral face of the friction wheel into account. However, this attempt is not practically applicable because the height of the truck must be increased with increase of the diameter of the friction wheel and there is brought about a disadvantage that a deep pit for the truck must be formed.

BRIEF SUMMARY OF INVENTION

The truck driving apparatus of the present invention comprises a driving shaft arranged along a running pathway of a truck and a ring-like friction disc fixed onto a rotation shaft mounted on the truck, wherein said friction disc has a friction face intersecting the rotation axis of said rotation shaft substantially at right angles. The friction face of the friction disc is pressed onto the driving shaft, and said rotation shaft is arranged so that the rotation axis of the rotation shaft is slightly inclined with respect to a plane intersecting the rotation axis of the driving shaft at right angles. According to the present invention, the friction wheel is so arranged that the height of a truck need not be increased even if the diameter of the friction wheel is increased, and a line-to-line contact is attained between the friction wheel and the driving shaft and a large driving force can be transmitted. Therefore, according to the present invention, there can be attained an advantage that heavy loads can be effectively transported.

Furthermore, even if the diameter of the friction disc is increased as compared with the diameter of the friction disc in the conventional apparatus, the height of the truck need not be increased because the rotation axis of the rotation shaft is movable relatively to the rotation axis of the driving shaft. By virture of this characteristic structure, line-to-line contact or face-to-face contact can be attained between the friction disc and the driving shaft, and the force of driving the truck can be remarkably increased and not only articles having a light weight but also articles having a heavy weight can be effectively transported.

Moreover, the position of the contact between the rotating board and the driving shaft is controlled by the engagement between the arm fixed to the bracket having the rotating board mounted thereon and the cam plate located on the ground side. Namely, the arm mounted on each truck falls in engagement with the cam plate located at an optional position on the ground side to cause the rotation shaft of the rotating board to make turning and parallel movements on the rotation axis of the driving shaft, whereby the truck can easily be stopped, and when the arm separates from the cam plate, the spring-urged bracket is immediately returned to the position for ordinary travelling. By virtue of this characteristic arrangement, according to the present invention, the operations of advancing the respective trucks, reducing the speeds of the respective trucks and stopping the respective trucks independently can easily be accomplished.

BRIEF DESCRIPTION OF DRAWINGS

FIGS. 1-A to 1-C are schematic plan views illustrating a contacting portion between a friction disc and a driving shaft when a truck is driven or stopped;

FIG. 2 is a partial front view in section illustrating a contacting portion between a wheel of the truck and a rail;

DETAILED DESCRIPTION OF INVENTION

Figure 3:
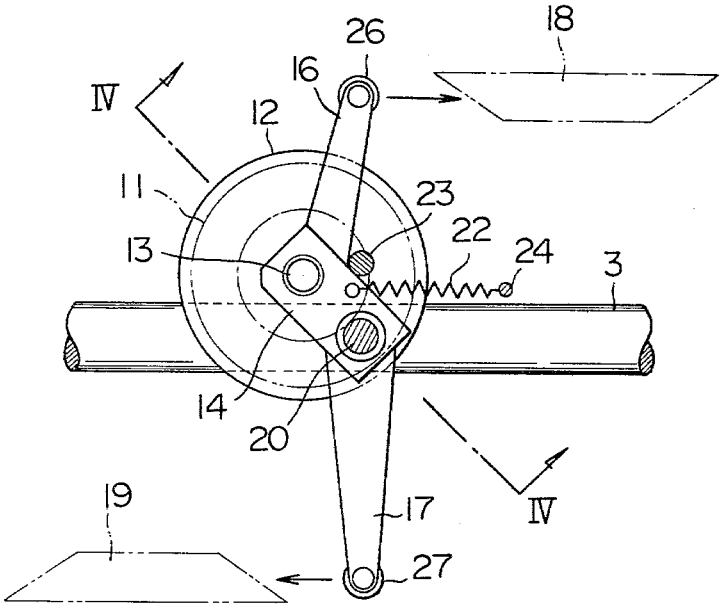
FIG. 3 is a partial plan view of a truck driving device in which a rotating board and a shaft thereof turn around a supporting shaft which acts as a center of turning.

The present invention will now be described with reference to embodiments illustrated in the accompanying drawings.

Referring to FIG. 1, a driving shaft 3 is arranged in parallel to two stationary parallel rails 1 and 2 so that the driving shaft 3 rotates between these two rails 1 and 2. A truck 4 is placed on the rails 1 and 2 through running wheels 5, 6, 7 and 8. The running wheels 5, 6, 7 and 8 have a known shape as shown in FIG. 2. Namely, each running wheel has such a shape that the lower face 9 and side face 10 of the running wheel fall in contact with the rail 1 and 2. A ring-like friction disc 11 is mounted on the lower portion of the truck by means of a mechanism mentioned below and is pressed against the driving shaft 3. The disc 11 is rotated on receipt of the driving force of the driving shaft 3 and the truck driving force is obtained by this rotation of the disc 11 co-operatively with the contact of the wheel with the rails.

In FIG. 1, symbol "0" represents a portion of the contact between the friction disc 11 and the driving shaft 3.

FIG. 1-A shows the state of the rotating board 12 while the truck is running. The friction disc 11 is rotated at a tangential speed indicated by arrow (a) by contact with the driving shaft 3, and the truck 4 is moved in an opposite direction indicated by arrow (c) at a speed of the component (b) of the speed (a) in the extending direction of the driving shaft 3. When the rotation direction of the driving shaft is reversed, the truck 4 is moved in the reverse direction.

FIG. 1-B shows the state of the rotating board 12 while the truck is stopped. The friction disc 11 is rotated at a tangential speed indicated by arrow (d), but the component of the speed (d) in the direction of the driving shaft 3 is zero and the truck 4 is kept stationary.

FIG. 1-C shows an embodiment in which rails 1*a* and 2*a* and driving shaft 3*a* are arranged to intersect the rails 1 and 2 and driving shaft 3 at right angles. Also in this embodiment, as is seen from FIG. 1-C, the truck 4 can be moved in either the forward direction or the reverse direction or can be stopped, Thus, according to the apparatus of the present invention, the truck 4 can be driven between pathways on the rails intersecting each other at right angles.

Conversion of the state shown in FIG. 1-A to the state shown in FIG. 1-B or conversion of the state shown in FIG. 1-B to the state shown in FIG. 1-A is accomplished by co-operative actions of levers 16 and 17 and cams 18 and 19 described hereinafter. For this conversion of the state, there may be adopted a method in which the rotating board 12 and shaft 13 are turned with a supporting shaft 20 acting as a center of turning with a certain distance between the shaft 13 and shaft 20 and a method in which the shaft 13 and the rotating board 12 are moved in parallel and in linear direction to the driving shaft 3. These methods will now be described.

Figure 4:
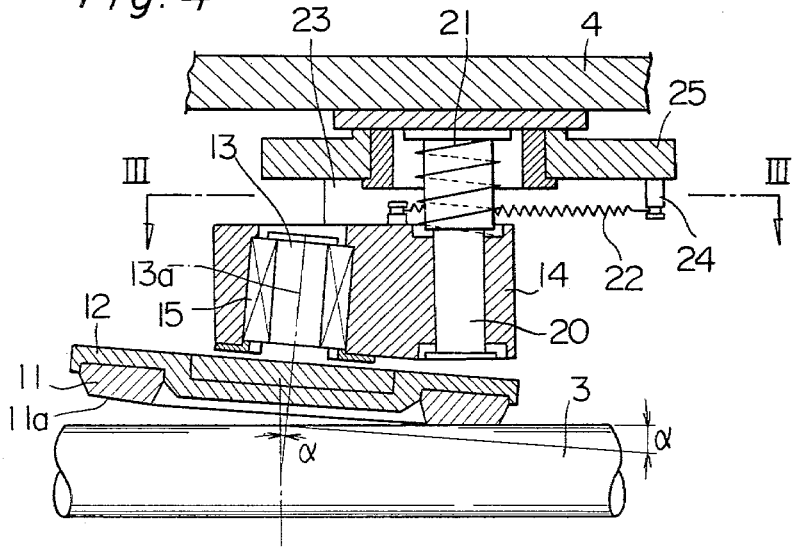
FIG. 4 is a section taken on line IV—IV in FIG. 3.

The turning method is shown in FIGS. 3 and 4 and the parallel moving method in which the shaft 13 and the rotating board 12 are moved obliquely in parallel to the driving shaft 3 is shown in FIGS. 5, 6, 7 and 8. In the method shown in FIGS. 9, 10 and 11, the shaft 13 and the rotating board 12 are moved at right angles in parallel to the driving shaft 3.

Referring to FIGS. 3 and 4, a supporting shaft 20 is vertically fixed to the truck 4 to intersect the rotation axis of the driving shaft 3 at right angles, and a bracket 14 is supported so that the bracket 14 can be vertically moved along said supporting shaft 20 and can be rotated relatively to said supporting shaft 20. The bracket 14 is downwardly urged by a spring wound on the supporting shaft 20, and therefore, the friction disc 11 is pressed against the driving shaft 3. The rotation shaft 13 is rotatably supported on the bracket 14 through a bearing 15 and the rotating board 12 is fixed to the lower end of the rotation shaft 13 and the ring-like friction disc 11 composed of a synthetic resin such as a urethane resin or a hard rubber is fixed to the lower face of the rotating board 12.

The rotation axis 13*a* of the rotation shaft 13 supporting the rotating board 12 intersects the rotation axis of the supporting shaft 20 with a small inclination angle $\alpha$. If the lower face of the friction disc 11 falls in contact with the driving shaft 3 in parallel to the axis thereof, the lower face of the ring-like friction disc 11 falls in contact with the driving shaft 3 simultaneously on both the sides of the rotation center and the rotation board 12 is not allowed to rotate. Therefore, the above-mentioned inclination angle $\alpha$ is provided. If the rotation axis 13*a* is thus inclined at the small angle $\alpha$, only one point of the lower face of the ring-like friction disc 11 is allowed to fall in contact with the driving shaft 3.

A friction face 11*a* which is a plane intersecting the rotation axis 13*a* substantially at right angles is formed on the lower face of the friction disc 11.

In the embodiment shown in FIG. 4, the friction face 11*a* is arranged so that there is formed a truncated conical face inclined at a small angle $\alpha$ from a plane intersecting the rotation axis 13*a* at right angles and having the rotation axis 13*a* as the center. Accordingly, the friction face 11*a* is allowed to fall in contact with the driving shaft 3 with a line-to-line contact.

In the embodiment shown in FIG. 3, the bracket 14 is urged in the clockwise direction with the supporting shaft 20 acting as the center by means of a spring 22, and in the state where the truck is normally advanced, the bracket 14 is kept in abutting contact with a stopper 23. In this state, the plane including the axes of the shafts 20 and 13 is inclined at about 45° relatively to the axis of the driving shaft 3 when viewed from above.

The fulcrum 24 of the spring 22 and the stopper 23 may be fixed to the truck 4, but if they are mounted on a rotating plate 25 capable of rotating with the axis of the supporting shaft 20 acting as the rotation center, the pathway of the truck can be shifted at right angles and the normal running speed of the truck can be adjusted.

Levers 16 and 17 have cam rollers 26 and 27 mounted on the top ends thereof, respectively, and are fixed to the bracket 14, and the cam rollers 26 and 27 are engaged with cams 18 and 19 mounted at predetermined positions of the running pathway. The bracket 14 is turned with the supporting shaft 20 being the center.

The truck driving apparatus in which the shaft 13 and the rotating board 12 are moved obliquely in parallel to the driving shaft will now be described.

Figure 5:
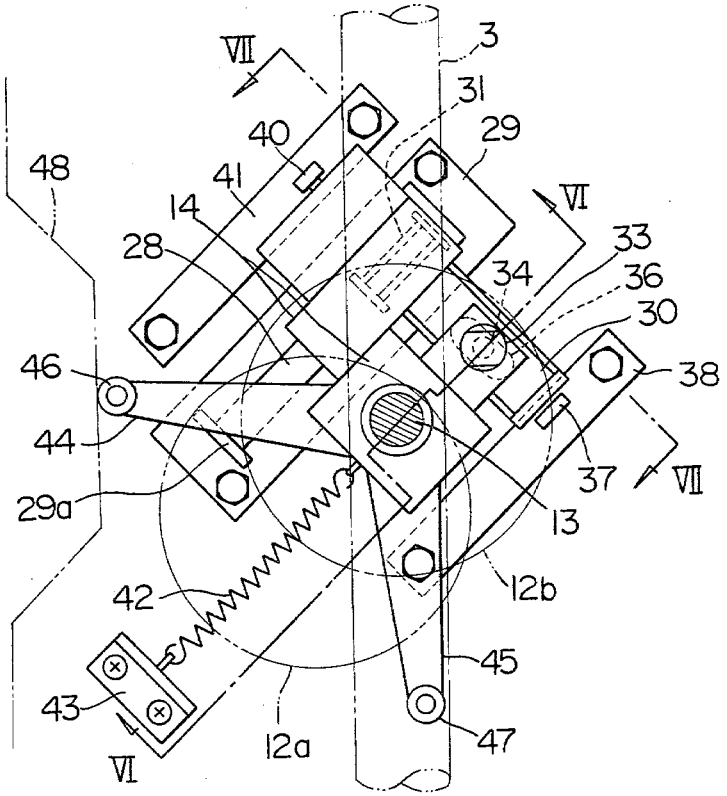
FIG. 5 is a partial plan view of a truck driving device in which a rotating board and a shaft thereof are moved in parallel and obliquely to the driving shaft.
Figure 6:
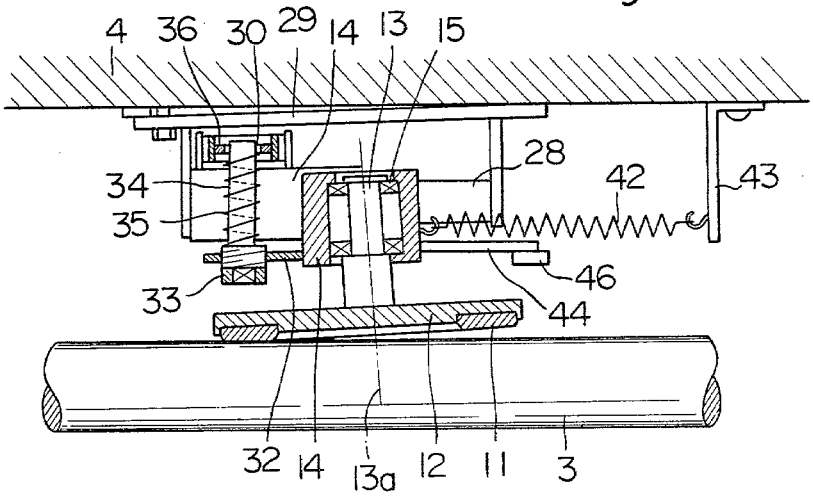
FIG. 6 is a section taken on line VI—VI in FIG. 5.
Figure 7:
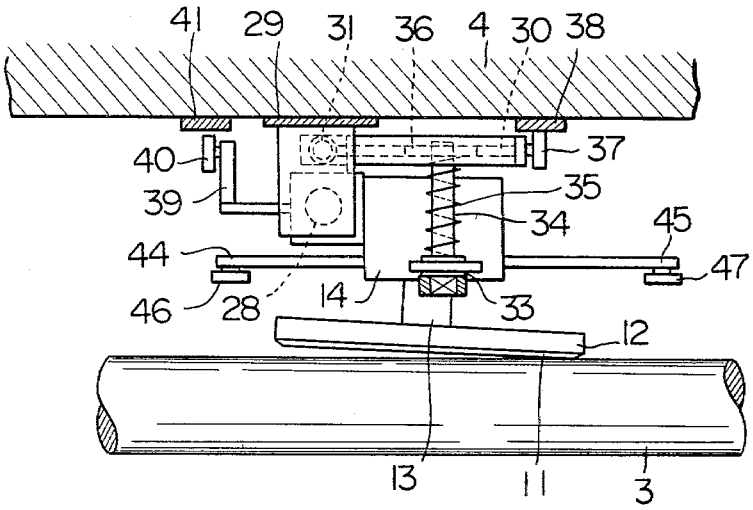
FIG. 7 is a section taken on line VII—VII in FIG. 5.

In FIGS. 5, 6 and 7, reference numeral 3 represents a driving shaft and reference numeral 28 represents a rod having an axis inclined relatively to the axis of the driving shaft 3. This rod 28 is fixed to the bottom face of the truck 4 by a bracket 29. Reference numeral 14 represents a bracket arranged slidably and turnably along and around the rod 28. The shaft 13 of the rotating board 12 having the ring-like friction disc 11 fixed thereto is rotatably supported on the bracket 14 through a bearing 15.

An auxiliary arm 30 is supported on the bracket 14 by a shaft 31 so that the arm 30 is allowed to perform swinging movement, and a compression spring 35 is wound on a core rod 34 of a bolt 33 screwed in a supporting piece 32 projected from and fixed to the bracket 14 between said bolt 33 and the auxiliary arm 30. By this spring 35, the bracket 14 is urged to swing with the rod 28 being the fulcrum, and by this urging force, the friction disc 11 is pressed against the driving shaft 3. This pressing force may be adjusted by turning the bolt 33. The top end of the core rod 34 is freely fitted in a long hole 36 of the auxiliary arm 30.

A roller 37 is rotatably supported on one end of the auxiliary arm 30, and this roller 37 is abutted against a guide plate 38 fixed to the lower face of the truck to support the reactive force of the ring-like friction disc 11 being pressed against the driving shaft 3.

Another supporting piece 39 is projected from and fixed to the bracket 14 on the side opposite to the auxiliary arm 30 with respect to the rod 28, and a roller 40 is rotatably supported on this supporting piece 39, and when the ring-like friction disc 11 passes through a joint portion of the driving shaft 3, the roller 40 falls in abutting contact with a guide plate 41 fixed to the lower face of the truck to control turning of the bracket 14 around the rod 28 within a certain range.

A tension spring 42 is spread between the bracket 14 and a bracket 43 fixed to the truck, and the bracket 14 is urged downwardly to the left in FIG. 5 by this spring 42. Supporting arms 44 and 45 are projected from and fixed to the bracket 14, and cam rollers 46 and 47 are rotatably supported on the top ends of the supporting arms 44 and 45, respectively.

Accordingly, while the bracket 14 is abutted against a supporting piece 29*a* of the bracket 29 by the spring 42 and the rotating board 12 is located at a position 12*a* shown in FIG. 5, the truck 4 is advanced, and when the cam roller 46 falls in engagement with a cam 48, the bracket 14 is located at a position indicated by a solid line in FIG. 5, and the rotating board 12 arrives at a position 12*b* and the truck 4 is stopped.

When the truck 4 is moved along the driving shaft 3*a* intersecting the driving shaft 3 at right angles, the cam roller 47 falls in engagement with a cam not shown in the drawings to move the bracket 14 along the rod 28 and control the travelling speed of the truck.

The axis 13*a* of the shaft 13 should be inclined at a certain small angle relative to the plane intersecting the driving shaft 3 at right angles. For this reason, the axis 13*a* is slightly inclined relative to the vertical line in the vertical plane intersecting the driving shaft 3 at an angle of about 45°. In this embodiment, there is a possibility that the amount of elongation of the spring 35 will be changed according to the movement of the point of contact between the friction disc 11 and the driving shaft 3, thus resulting in change of the pressing force of the friction disc 11 against the driving shaft 3. However, if the bracket 29 is inclined with respect to the lower face of the truck 4 as shown in FIG. 6, or the abutting face of the guide plate 38 to the roller 37 is slightly inclined with respect to the horizontal plane, the above-mentioned possibility is eliminated and the above-mentioned pressing force is kept constant.

In the embodiments shown in FIGS. 5 to 7, the movement of the bracket 14, that is, the movement of the rotating board 12, is performed by the supporting arms 44 and 45. Another embodiment of the means for moving the bracket 14 is illustrated in FIG. 8.

Figure 8:
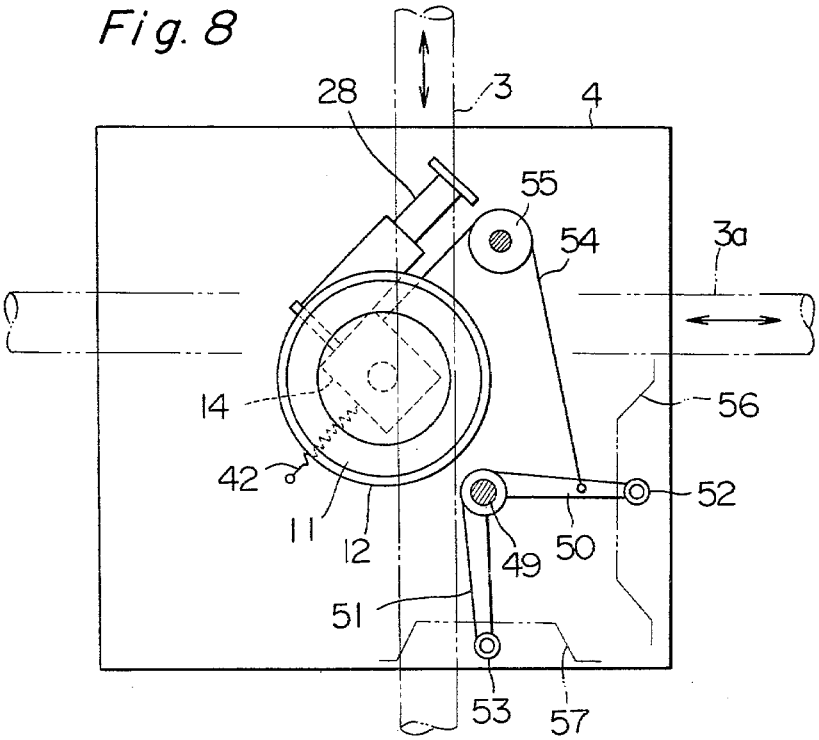
FIG. 8 is a diagrammatic plan view illustrating another embodiment of the truck driving device in which the rotating board and the shaft thereof are moved in parallel and obliquely to the driving shaft.

In the embodiment shown in FIG. 8, levers 50 and 51 are swingably supported integrally on the lower face of the truck 4 by means of a shaft 49, and cam rollers 52 and 53 are supported on the top ends of the levers 50 and 51, respectively. One end of a rope 54 is connected to the bracket 14 and the other end of the rope 54 is connected to one of the levers 50 and 51. A guide roller 55 for the rope 54 is rotatably supported on the lower face of the truck 4.

When the truck 4 is driven along the driving shaft 3, the movement of the bracket 14 is controlled through the rope 54 by the co-operation of the cam roller 52 and a cam 56, and when the truck 4 is travelled along the driving shaft 3*a*, the movement of the bracket 14 is controlled through the rope 54 by the co-operation of the cam roller 53 and a cam 57.

In the embodiment shown in FIG. 8, the force for moving the bracket 14 is amplified in the portion of the levers 50 and 51 and smooth movement of the bracket 14 is guaranteed.

An embodiment in which the shaft 13 and the rotating board 12 are moved in the rectangular direction in parallel to the driving shaft 3 will now be described.

Figure 9:
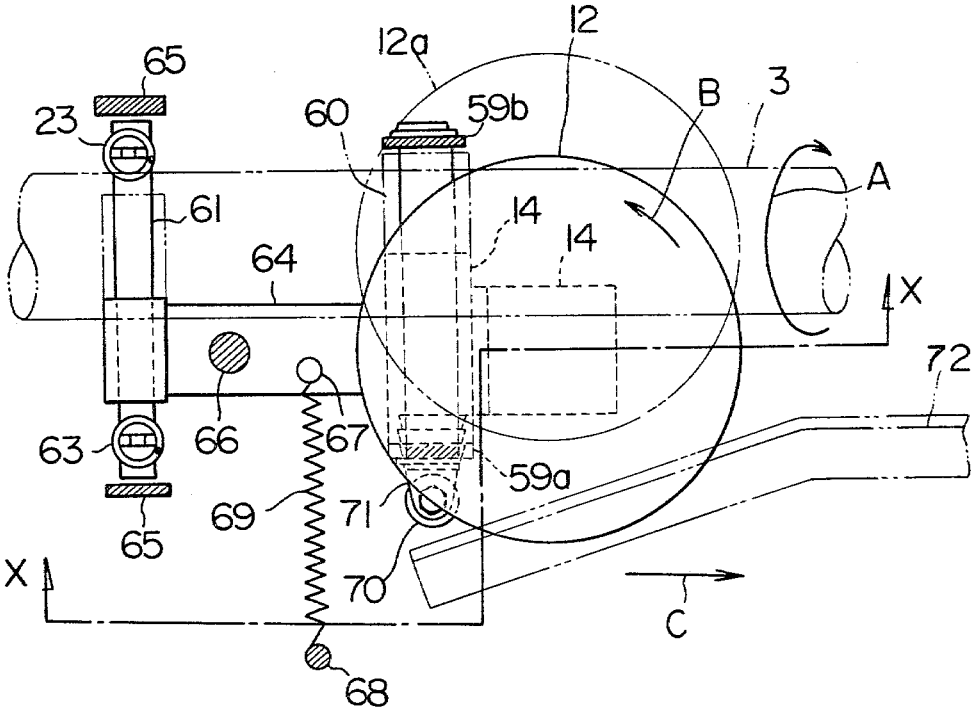
FIG. 9 is a partial plan view of the truck driving device in which the rotating board and the shaft thereof are moved in parallel and at a right angle to the driving shaft.
Figure 10:
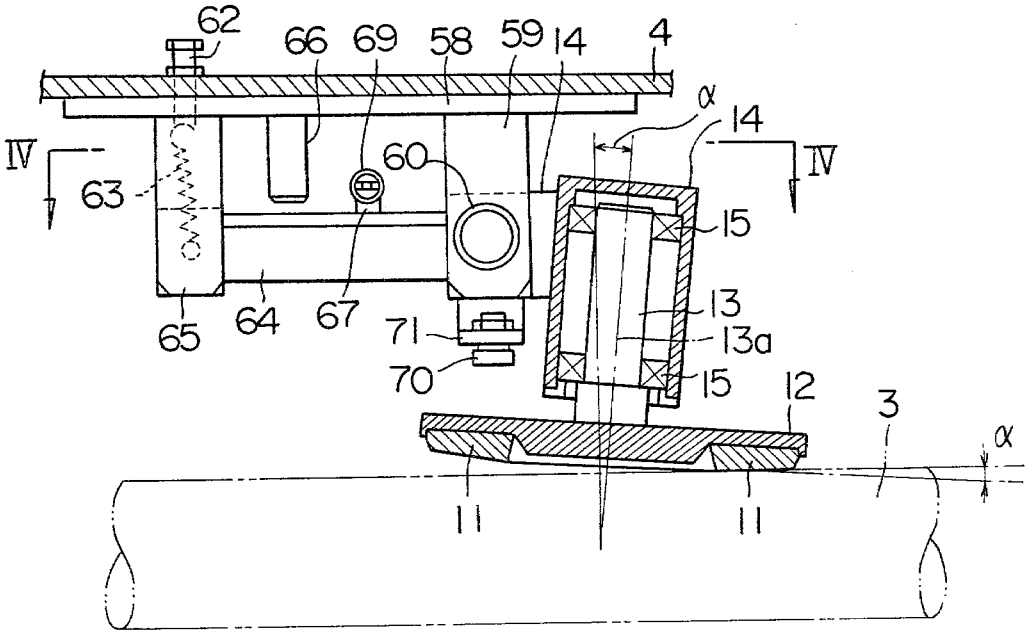
FIG. 10 is a section taken on line X—X in FIG. 9.

Referring to FIGS. 9 and 10, a supporting plate 58 is fixed to the lower face of the truck 4, and a rod 60 is fixed between brackets 59*a* and 59*b* vertically fixed to and hung from the supporting plate 58 so that the rod 60 intersects the rotation axis of the driving shaft 3 at right angles. Precisely speaking, the rod 60 is arranged in a plane intersecting the rotation axis of the rotation shaft 3 at right angles and is disposed horizontally or is slightly inclined relative to the horizontal plane.

The bracket 14 is slidably and turnably fitted in the rod 60, and the rotation shaft 13 is rotatably supported into the bracket 14 by means of the bearing 15 and the ringlike friction disc 11 is fixed to the lower face of the rotating board 12 mounted on the lower end of the rotation shaft 13 so that the friction disc 11 intersects the rotation axis of the rotation shaft 13 at right angles.

The rotation axis 13*a* of the rotation shaft 13 is inclined at a small angle $\alpha$ relatively to a plane intersecting the rotation axis of the driving shaft 3 at right angles so that the friction disc 11 falls in contact with the driving shaft 3 at one point.

The contact face 11*a* of the friction disc 11 has a truncated conical shape inclined at an angle $\alpha$ with respect to the plane intersecting the rotation axis 13*a* of the rotation shaft 13 at right angles, and by virtue of this conical shape and the resilient property of the friction disc 11, the friction disc 11 is allowed to have a line-to-line or face-to-face contact with the driving shaft 3.

A rod 61 is supported on the lower end of a spring 63 hung on an adjust bolt 62 having the top end fixed to the truck 4, and this rod 61 is arranged substantially in parallel to the rod 60.

An arm 64 is projected from the bracket 14 and one end of the arm 64 is slidably fitted in the rod 61, and a spring 63 is arranged so that the arm 64 is urged in the clockwise direction with the rod 60 being the fulcrum and is pressed against the driving shaft 3. A plate 65 is vertically fixed to and hung from the supporting plate 58 at a position confronting both the end faces of the rod 61 to prevent random movement of the rod 61. A stopping pin 66 is projected from the supporting plate 58 and is abutted against the arm 64 to prevent unnecessary turning of the arm 64 and to assist the friction disc 11 to pass smoothly through point and cut portions of the driving shaft 3.

A spring 69 is spread between a pin 67 projected on the arm 64 and a pin 68 projected on the supporting plate 58, and the bracket 14 is urged downwardly in FIG. 9 by means of this spring 69.

While the truck 4 is advanced in a forward direction, the friction disc 11 is located at a position indicated by a solid line in FIG. 10, and in this state, one end of the bracket 14 is abutted against the bracket 59*a* and thus fixed by the spring 69. Accordingly, when the driving shaft 3 is rotated in a direction indicated by arrow A, the friction disc 11 and rotating board 12 are rotated in a direction indicated by arrow B and the truck 4 is driven in a direction indicated by arrow C.

A cam roller 70 is rotatably supported on the top end of an arm 71 projected from and fixed to the lower face of the bracket 14, and when the cam roller 70 falls in engagement with a cam plate 72 on the ground side as the truck 4 travels, the bracket 14 and rotation shaft 13 are moved upwardly in FIG. 9, that is, in the direction intersecting the rotation axis of the driving shaft 3, against the spring 69, and when the rotating board 12 arrives at a position indicated by a chain line 12*a*, that is, when the rotation shaft 13 is located on the axis of the driving shaft 3, movement of the truck is stopped.

Figure 11:
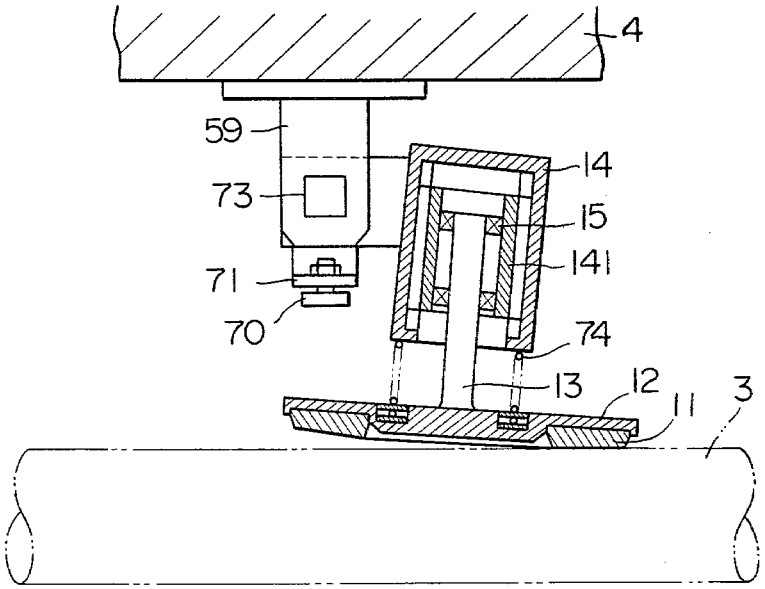
FIG. 11 is a diagrammatic view partially in section illustrating more another embodiment of the truck driving device in which the rotating board and the shaft thereof are moved in parallel and at right angles to the driving shaft.

FIG. 11 illustrates another embodiment in which the structure is more simplified. A square rod 73 is used instead of the rod 60 shown in FIG. 10. The rotation shaft 13 is supported on a sliding piece 141 vertically slidably fitted in the bracket 14 through a bearing 15. The friction disc 11 is urged and pressed against the driving shaft 3 by a spring 74 inserted between the bracket 14 and rotating board 12.

What is claimed is:

1. A driving means for a truck having at least one wheel rotatably connected to said truck and positioned on at least one track for moving said truck, and a drive shaft disposed along said track for providing motor power to said driving means to propel said truck; said driving means comprising (A) a supporting shaft vertically fixed to and hung from said truck;

(B) a bracket supported on said supporting shaft so that the bracket can move along said supporting shaft and rotate relative to said supporting shaft;

(c) a rotation shaft rotatably supported on said bracket;

(D) a ring like friction disc fixed to a lower end of said rotation shaft, wherein said friction disc has a friction face intersecting the rotational axis of said rotation shaft substantially at right angles;

(E) a spring mounted on said supporting shaft to urge said bracket to press said friction face onto said driving shaft, said rotation shaft being disposed so that the rotation axis of said rotation shaft is slightly inclined with respect to a plane intersecting the rotation axis of said driving shaft at right angles;

(F) a second spring;

wherein said bracket is urged by said second spring to turn around said supporting shaft;

(G) a stop means positioned to control the stopped turning movement of said bracket so that said stop means falls in abutting contact with said bracket at the stopped position;

(H) a cam mounted on said track; and (I) an arm fixed to said bracket whereby said arm is abutted against said cam to turn said bracket around said support shaft.

2. A driving means for a truck having at least one wheel rotatably connected to said truck and positioned on at least one track for moving said truck, and a drive shaft disposed along said track, for providing motor power to said driving means to propel said truck; said driving means comprising (A) a rod fixed to a bottom face of said truck so that said rod has an axis inclined at a certain angle relative to the axis of said drive shaft;

(B) a bracket slidably and turnably arranged on said rod;

(C) a rotation shaft rotatably supported on said bracket;

(D) a ring like friction disc fixed to a lower end of said rotation shaft, wherein said friction disc has a friction face intersecting the rotational axis of said rotation shaft substantially at right angles;

(E) a supporting piece fixed to said bracket;

(F) a bolt having a core rod screwed in said supporting piece;

(G) a compression spring wound on said core of said bolt;

wherein said bracket is urged toward said drive shaft by said compression spring to press the friction face against said drive shaft, said rotation shaft being arranged so that the rotation axis of said rotation shaft is slightly inclined with respect to a plane intersecting the rotation axis of said drive shaft at right angle;

(H) a second spring spread between said first bracket and a second bracket;

(I) a second bracket fixed to said truck and being urged slidably along said rod by said second spring;

(J) an arm fixed to said first bracket;

(K) a cam mounted on said truck;

(L) a cam roller supported on the top end of said arm, wherein said cam roller is abutted against said cam to slide said second bracket along said rod.

3. The driving means of claim 2, further comprising a plurality of levers, said levers being swingably supported integrally on a lower face of said truck; and a rope connected to one end of said second bracket and at the other end to one of said levers; and said support cam rollers being on the top end of another of said levers.

4. A driving means for a truck having at least one wheel rotatably connected to said truck and positioned on at least one track for moving said truck; and a drive shaft positioned along said track for providing motor power to said drive means to propel said truck; said driving means comprising (A) a pair of brackets;

(B) a first rod fixed under a lower face of said truck by said pair of brackets so that said rod intersects the rotational axis of said driving shaft at right angles;

(C) a third bracket arranged slidably and turnably on said first rod;

(D) an adjusting bolt on said truck;

(E) a first spring hung on said adjusting bolt;

(F) a second rod supported on a lower end of said first spring and arranged substantially parallel to said first rod;

(G) a rotation shaft rotatably supported on said third bracket;

(H) a ring like friction disc fixed to a lower end of said rotation shaft;

wherein said friction disc has a friction face intersecting the rotational axis of said rotation shaft substantially at right angles;

(I) an arm projected from said third bracket;

wherein, said third bracket being urged by said first spring to be pressed to said drive shaft by said arm; said rotation shaft being arranged so that the rotation axis of said rotation shaft is slightly inclined with respect to a plane intersecting the rotational axis of said drive shaft at right angles;

(J) a cam roller supported on said arm;

(K) a cam plate;

(L) a pin fixed on the lower face of said truck;

(M) a second spring spread between said arm and said pin;

whereby said third bracket and rotation shaft are moved in a direction intersecting the rotational axis of said drive shaft against the second spring when said cam roller falls into engagement with said cam plate.

5. The driving means of claim 4, wherein said first rod is a square rod, and wherein a substantially flat rotary board is provided having a ring like friction disc on the flat surface contactable with said drive shaft; and a spring is disposed between said third bracket and said rotary board whereby said friction disc is urged and pressed against said drive shaft.

* * * * *